US006463897B2

(12) United States Patent
Fernandez et al.

(10) Patent No.: US 6,463,897 B2
(45) Date of Patent: Oct. 15, 2002

(54) MECHANICAL ASSIST ACTUATION BRACKET FOR DEACTIVATION AND TWO-STEP ROLLER FINGER FOLLOWERS

(75) Inventors: Hermes A. Fernandez, Rochester; Ryan D. Fogarty, West Henrietta; Jongmin Lee, Pittsford; Wayne S. Harris, Hilton, all of NY (US); Nick J. Hendriksma, SE Grand Rapids, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/906,277

(22) Filed: Jul. 16, 2001

(65) Prior Publication Data

US 2001/0045197 A1 Nov. 29, 2001

Related U.S. Application Data

(63) Continuation-in-part of application No. 09/829,738, filed on Apr. 10, 2001.

(60) Provisional application No. 60/204,622, filed on May 16, 2000.

(51) Int. Cl.[7] ..... F01L 1/34

(52) U.S. Cl. ..... 123/90.16; 123/90.15; 123/90.39

(58) Field of Search ..... 123/90.16, 90.15, 123/90.12, 90.39, 90.42, 90.44

(56) References Cited

U.S. PATENT DOCUMENTS 6,321,705 B1 * 11/2001 Fernandez et al. ..... 123/90.16

* cited by examiner

*Primary Examiner*—Thomas Denion
*Assistant Examiner*—Sean O'Brien
(74) *Attorney, Agent, or Firm*—Patrick M. Griffin

(57) ABSTRACT

A mechanical assist actuation bracket for use with a roller finger follower. The roller finger follower includes a locking pin assembly having a trigger pin. The mechanical assist actuation bracket includes a face configured for being affixed to the roller finger follower. An arm extends from the face. The arm is configured for translating an actuating arm of an actuating device associated with the roller finger follower in a direction toward and away from the trigger pin during pivotal movement of the roller finger follower.

20 Claims, 3 Drawing Sheets

MECHANICAL ASSIST ACTUATION BRACKET FOR DEACTIVATION AND TWO-STEP ROLLER FINGER FOLLOWERS

CROSS REFERENCE TO RELATED APPLICATIONS

This application is a continuation-in-part of U.S. patent application Ser. No. 09/829,738, filed, Apr. 10, 2001, entitled, Actuation Mechanism for Mode-Switching Roller Finger Follower which, in turn, claims the benefit of U.S. Provisional Patent Application Serial No. 60/204,622, filed May 16, 2000.

TECHNICAL FIELD

The present invention generally relates to actuation mechanisms for use with deactivation and two-step roller finger followers (RFFs).

BACKGROUND OF THE INVENTION

Deactivation RFFs typically include a body and a roller carried by a shaft. The roller is engaged by a cam of an engine camshaft that causes the RFF body to pivot, thereby actuating an associated engine valve. The deactivation RFF is selectively switched between a coupled and a decoupled mode of operation. In the coupled mode the shaft is coupled to the body, and rotation of the output cam is transferred from the roller through the shaft to pivotal movement of the RFF body, which, in turn, reciprocates the associated valve. In the decoupled mode, the shaft is decoupled from the body. Thus, the shaft does not transfer rotation of the output cam to pivotal movement of the RFF body and the associated valve is deactivated, i.e., not lifted or reciprocated, and therefore the term deactivation is used to describe this type of RFF. Zero-lift lobes on either side of the main cam engage and maintain the RFF body in a fixed position while in the decoupled mode of operation.

A two-step RFF operates in a manner similar to a deactivation RFF, as described above. However, rather than the body being engaged by zero-lift cam lobes as in the case of a deactivation RFF, the body of the two-step RFF is engaged by low-lift cam lobes. In the decoupled mode, the body of the two-step RFF is pivoted by the low-lift lobes thereby actuating the associated engine valve according to the lift profile of the low-lift cam lobes. In the coupled mode, the body of the two-step RFF is pivoted by the main cam thereby actuating the associated engine valve according to the lift profile of the main cam. Thus, the two-step RFF activates the associated valve according to a selected one of two different lift profiles, and therefore the term two step is used to describe this type of RFF.

The term RFF, as used hereinafter, encompasses both a deactivation RFF and a two-step RFF. Both types of RFFs are selectively switched between the coupled and decoupled modes of operation through the use of a locking pin assembly that couples and decouples the shaft to and from the RFF body. Typically, the locking pin assembly is a two-part pin that is biased by an associated spring into a default position, such as, for example, the decoupled position wherein the shaft is decoupled from the RFF body. In order to switch the locking pin assembly, and thus the RFF, between the coupled and decoupled modes, an actuating device is associated with the locking pin assembly. The actuating mechanism engages a trigger pin of the locking pin assembly to place and maintain the RFF in a first mode, such as, for example, the coupled mode. The actuating mechanism disengages from the trigger pin to thereby enable an internal spring of the locking pin assembly to bias the assembly into the second mode, such as, for example, the default/decoupled mode.

The actuating mechanism, such as, for example, a direct acting electro-mechanical solenoid or hydraulic actuator, engages the locking pin assembly to thereby place the locking pin assembly in one of the coupled and decoupled positions, such as, for example, the coupled position. In order to engage the locking pin assembly, an actuating mechanism must be disposed adjacent to the locking pin assembly of each RFF, and within the limited space available in the head of modern engines. Further, the actuating mechanism must provide sufficient force and stroke length in order to translate the locking pin mechanism, and thereby switch the mode of the RFF. Such direct acting mechanism require relatively large amounts of input power to initiate motion at relatively long distances. Moreover, the actuating mechanism must be precisely aligned with the locking pin assembly of the RFF in order to ensure smooth switching between modes.

Therefore, what is needed in the art is a device that enables the use of a smaller, less powerful actuating mechanism.

Furthermore, what is needed in the art is a device that reduces the distance over which the actuating mechanism must act, and thus reduces the amount of electrical current required to drive the actuating mechanism.

Moreover, what is needed in the art is a device that increases the alignment tolerance between the locking pin assembly of the RFF and the actuating mechanism.

SUMMARY OF THE INVENTION

The present invention provides a mechanical assist actuation bracket for use with a deactivation and/or two-step roller finger follower. The roller finger follower includes a locking pin assembly having a trigger pin.

The invention comprises, in one form thereof, a mechanical assist actuation bracket configured for being affixed to the roller finger follower. The bracket includes a face and an arm extending from the face. The arm is configured for translating an actuating arm of an actuating device associated with the roller finger follower in a direction toward and away from the trigger pin during pivotal movement of the roller finger follower.

An advantage of the present invention is that the bracket, by translating the actuating arm of the actuating device, reduces the power requirements of the actuating device thereby enabling the use of an actuating device having a reduced power rating and a smaller size. Another advantage of the present invention is that the bracket reduces the distances over which the actuating mechanism associated with the RFF must act, and thereby reduces the amount of electrical drive current required by the actuating mechanism.

Yet another advantage of the present invention is that the bracket increases the alignment tolerance between the actuating mechanism and the trigger pin of the locking pin assembly.

A still further advantage of the present invention is that mode switching of the roller finger follower occurs during the base circle phase of the cam event, and thus the switching event is self-timed.

An even further advantage of the present invention is that the mode switching event of the roller finger can utilize the entire base circle phase of the cam event, thus allowing substantial time for the switching event to occur.

BRIEF DESCRIPTION OF THE DRAWINGS

The above-mentioned and other features and advantages of this invention, and the manner of attaining them, will become apparent and be better understood by reference to the following description of one embodiment of the invention in conjunction with the accompanying drawings, wherein.

Corresponding reference characters indicate corresponding parts throughout the several views. The exemplification set out herein illustrates the preferred embodiment of the invention and such exemplification is not to be construed as limiting the scope of the invention in any manner.

DESCRIPTION OF THE PREFERRED EMBODIMENTS

Figure 1:
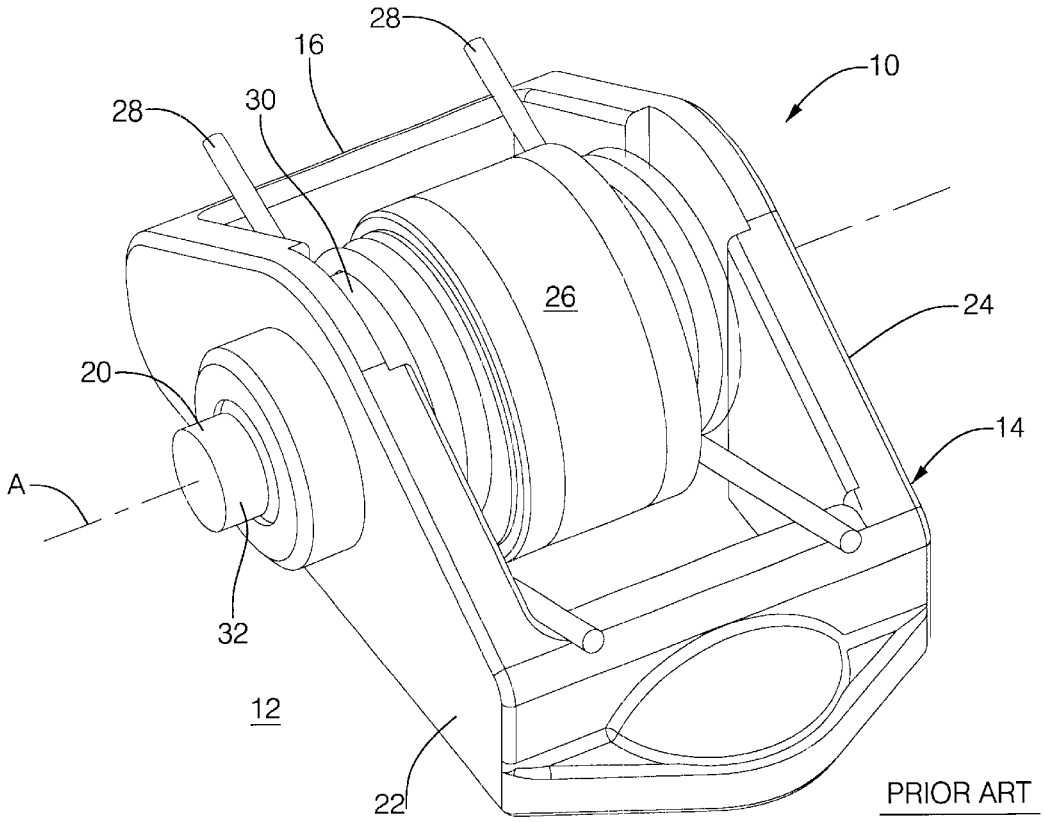
PRIOR ART FIG. 1
FIG. 1 is a perspective view of a roller finger follower.

Referring now to the drawings, and particularly to FIG. 1, there is shown a roller finger follower 10. Roller finger follower (RFF) 10 is installed in internal combustion engine 12. RFF 10 includes body 14 having a first end 16 that, in use, engages a valve stem of an associated valve (neither of which are shown) of engine 12, and a second end (not referenced) engages a stem of a lash adjuster (neither of which are shown) of engine 12. In the embodiment shown, RFF 10 is configured as, for example, a deactivation RFF. However, it is to be understood that the mechanical assist actuation bracket of the present invention can be configured for use with either a deactivation RFF or a two-step RFF.

RFF 10 further includes locking pin assembly 20, sides 22 and 24, roller 26, lost motion springs 28 and shaft 30. Roller 26 is engaged by a cam of a camshaft (neither of which are shown) of engine 12. Locking pin assembly 20 has central axis A, and is disposed within hollow shaft 30, which is also substantially concentric relative to central axis A. In the coupled mode, locking pin 20 engages orifices (not shown) in a respective inside surface of each of sides 22 and 24 to thereby couple shaft 30 and roller 26 to RFF body 14. With RFF 10 in the coupled mode, rotary motion of the cam is transferred by roller 26 and shaft 30 to pivoting of RFF body 14 to thereby reciprocate the valve stem and actuate the associated valve. Locking pin assembly 20 includes trigger pin 32. Trigger pin 32 is biased by an internal spring (not shown) of locking pin assembly 20 to thereby position locking pin assembly 20 in, for example, the coupled mode.

Trigger pin 32 is engaged by an actuating member, and is thereby translated axially inward, i.e., in the direction toward side 24 to thereby place RFF 10 in, for example, the decoupled mode. In the decoupled mode, the pin members of locking pin assembly 20 align such that shaft 30 and roller 26 are decoupled from RFF body 14. Thus, rotary motion of the cam is transferred to reciprocation of roller 26, rather than to pivotal motion of RFF body 14. Valve stem 18 is not pivoted, and the associated valve is not actuated by the motion of the cam while RFF 10 is in the decoupled mode. With RFF 10 in the decoupled mode and configured as a two-step RFF, the valve would be actuated according to low-lift cam lobes disposed on either side of the cam that engages roller 26. In the decoupled mode, lost motion springs 28 absorb the motion of roller 26 and maintain roller 26 in contact with the cam.

Figure 2:
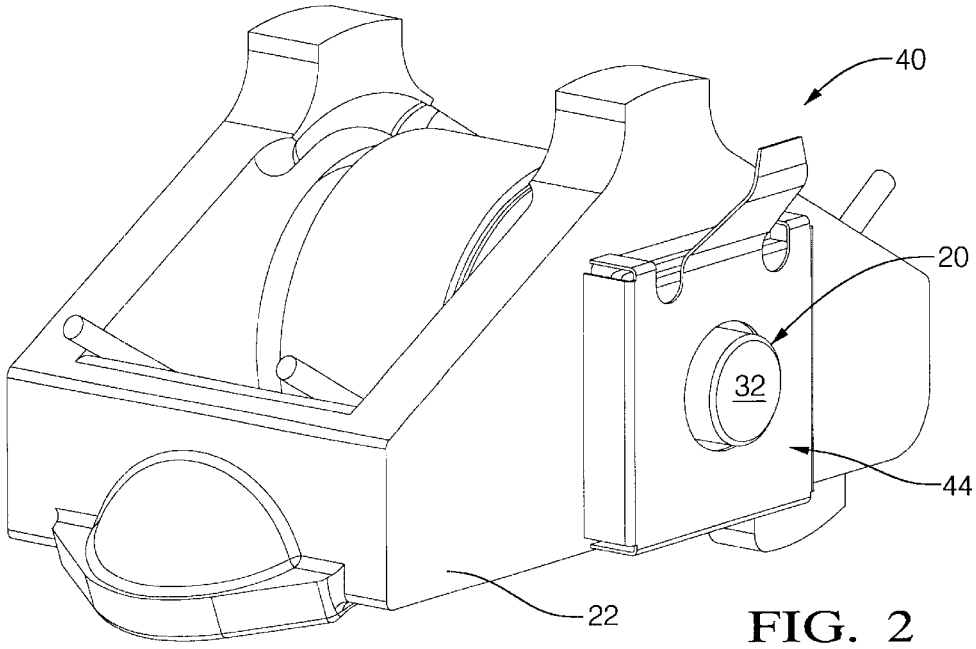
FIG. 2 is a perspective view of a roller finger follower incorporating one embodiment of the mechanical assist actuation bracket of the present invention.

Referring now to FIG. 2, one embodiment of a RFF of the present invention is shown. RFF 40 is generally similar to and has many parts in common with RFF 10, and corresponding reference characters indicate corresponding parts common to RFF 10 and RFF 40. RFF 40 includes mechanical assist actuation bracket 44, which is attached, such as, for example, by a snap or crimp fit or other suitable means, to side 22 of RFF body 12.

Figure 3:
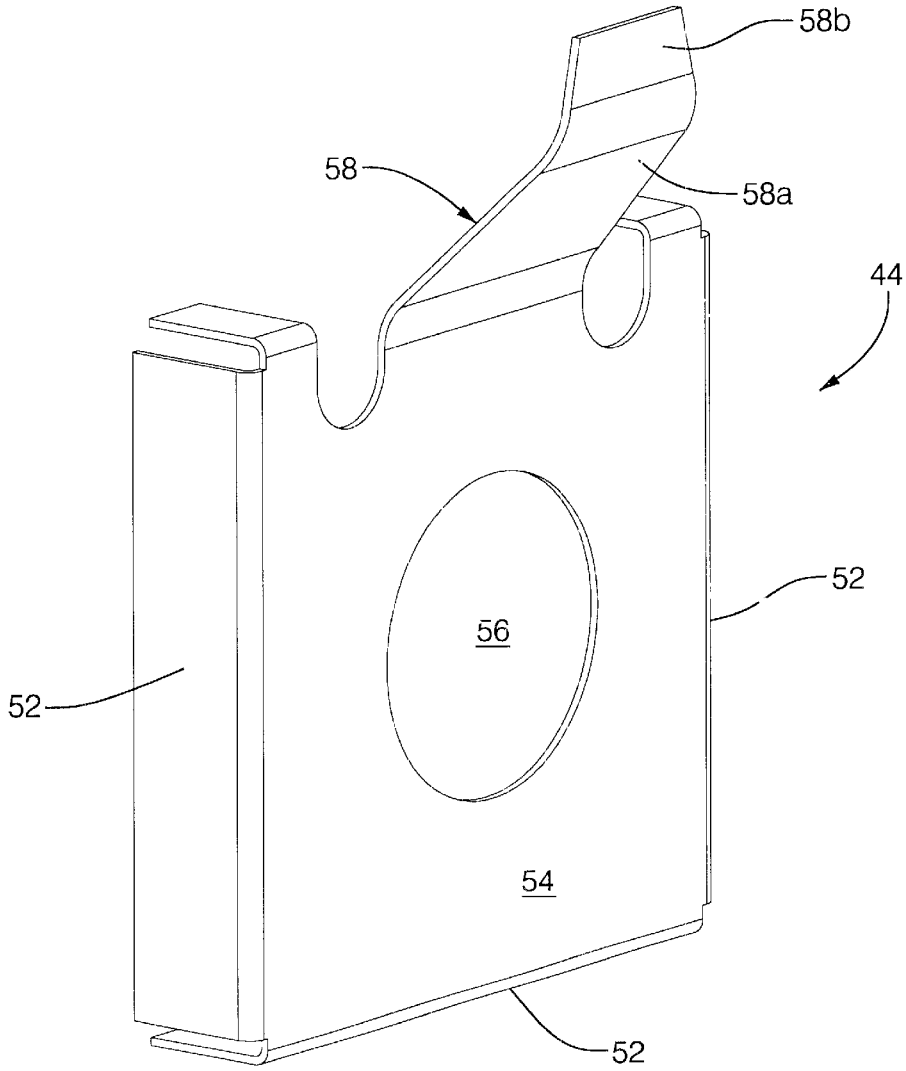
FIG. 3 is a perspective view of the mechanical assist actuation bracket of FIG. 2.

As best shown in FIG. 3, bracket 44 includes sides 52 that are interconnected and spaced apart by face 54. Face 54 includes central orifice 56, through which trigger pin 32 extends (as shown in FIG. 2). Central orifice 56 is dimensioned such that it does not interfere with the displacement of trigger pin 32 in a direction toward and away from side 22 required to switch RFF 10 between the decoupled and coupled modes of operation. Bracket 44 further includes an elongate, generally L-shaped angled arm 58.

Arm 58 includes first portion 58*a* and second portion 58*b*. First portion 58*a* extends from face 54 in a direction away from side 22 and at an angle of from approximately twenty degrees to approximately seventy-five degrees relative to the plane of face 54. Second portion 58*b* of arm 58 is angled such that it is substantially parallel relative to the plane of face 54. L-shaped arm 58 and bracket 44 are constructed of, for example, spring steel.

As stated above, an actuating device, such as, for example, an electric or hydraulic solenoid, is associated with each RFF 40 in order to actuate trigger pin 32 and thereby switch RFF 40 between the decoupled and coupled modes of operation. As will be described more particularly hereinafter, bracket 44, and thus RFF 40, reduces the distance through and the force with which the actuating device must act to translate pin assembly 20. Thus, the drive current required in order to activate the actuating device is reduced, thereby enabling the use of a smaller actuating device to activate RFF 40 and the electrical current required in order to energize the actuator is reduced. Further, bracket 44, and thus RFF 40, increases the positioning tolerance of the actuating device relative to RFF 40.

Figure 4A:
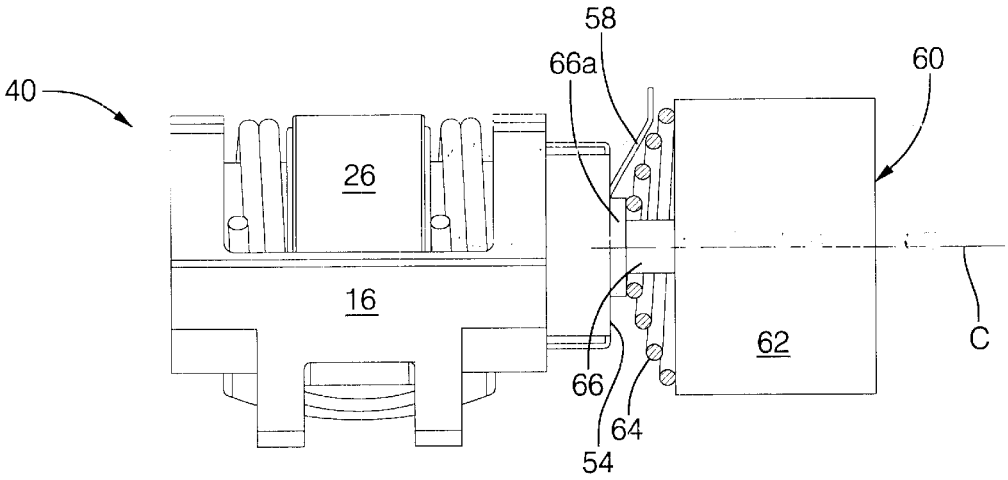
FIG. 4A is a perspective view of the roller finger follower and mechanical assist actuation bracket of FIG. 2 installed in operable relation with an actuating device.
Figure 4B:
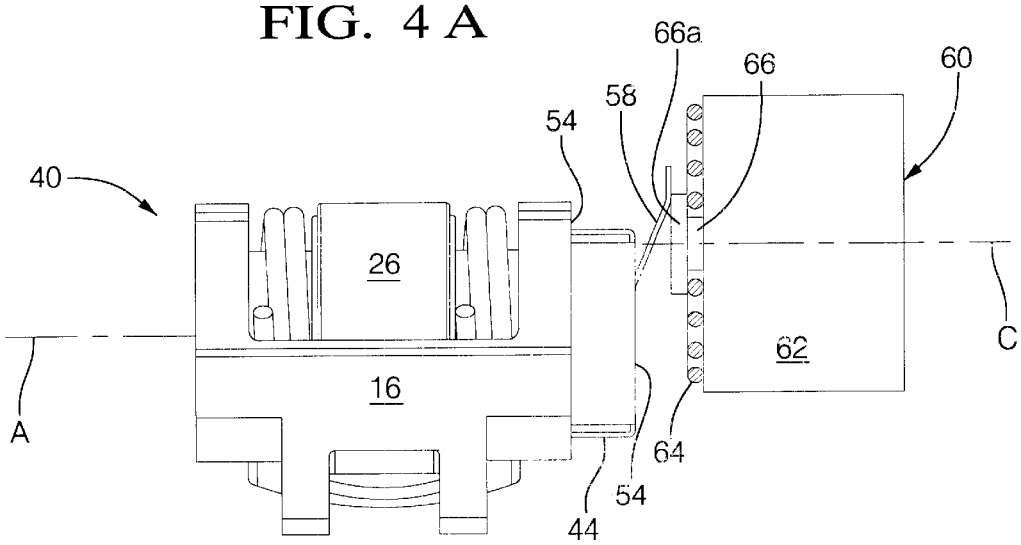
FIG. 4B is a perspective view of the roller finger follower and mechanical assist actuation bracket of FIG. 2 installed in operable relation with an actuating device.
Figure 4C:
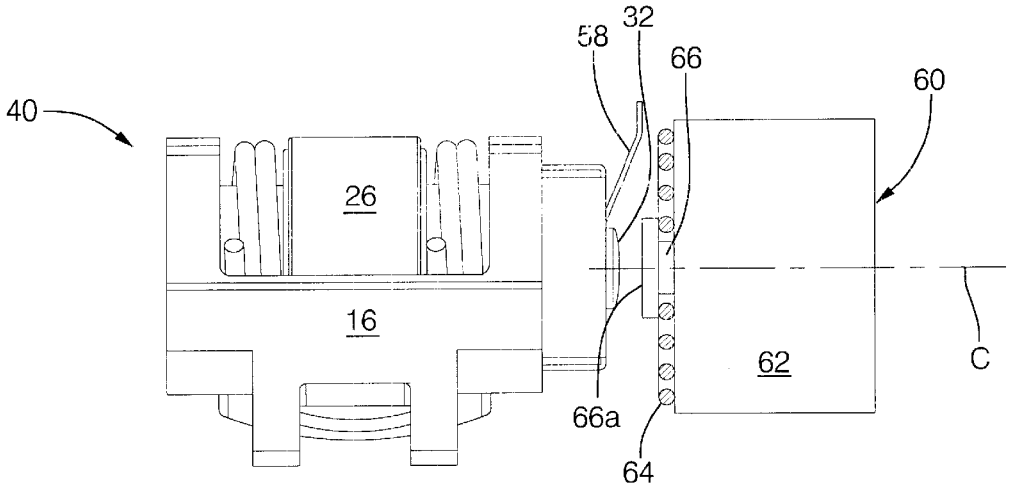
FIG. 4C is a perspective view of the roller finger follower and mechanical assist actuation bracket of FIG. 2 installed in operable relation with an actuating device.

In use, as best illustrated in FIGS. 4A–4C, RFF 40 is operably disposed in association with actuating device 60, such as, for example, a hydraulic or electric solenoid. Actuating device 60 generally includes body 62, spring 64 and actuating arm 66. Spring 64 engages each of body 62 and end 66*a* of actuating arm 66, thereby biasing actuating arm 66 into a fully extended position (FIG. 4A). Actuating device 60 is disposed adjacent RFF 40, with centerline C of actuating arm 66 generally concentric with central axis A of locking pin assembly 20.

FIG. 4A depicts RFF 40, or more particularly roller 26 thereof, on the base circle of the cam of the camshaft of engine 12. Actuating arm 66 is fully extended by spring 64 into engagement with trigger pin 32 of locking pin assembly 20. The force exerted by spring 64 upon actuating arm 66 in a direction toward RFF 40 is of sufficient magnitude to translate trigger pin 32 in the direction of side 24 of RFF body 14, and thereby dispose locking pin assembly 20 in the coupled position. End 66*a* of actuating arm 66 is in engagement with trigger pin 32 of locking pin assembly 20 and with face 54 of bracket 44. End 66*a* is dimensioned such that it is somewhat larger than orifice 56 of bracket 44, and thus does not extend into or through orifice 56. Thus, actuating arm 66 translates trigger pin 32 axially such that locking pin assembly 20 is placed into the coupled position to thereby place RFF 40 in the coupled mode of operation.

Referring now to FIG. 4B, RFF 40 is depicted during a valve opening event, i.e., roller 26 is engaged by the lift profile or nose of the cam of the camshaft of engine 12. RFF body 12 is pivoted about the lash adjuster (not shown) such that first end 16 of RFF body 12 is pivoted downward, i.e., toward the associated valve, such that central axis A is somewhat lower than centerline C of actuating arm 66. RFF body 12 carries bracket 44, and thus bracket 44 and arm 58 thereof are displaced in the same direction as RFF body 12. As RFF body 12 pivots, first, angled portion 58*a* of arm 58 progressively engages end 66*a* of actuating arm 66. More particularly, as RFF body 12 pivots, arm 58 moves downward relative to end 66*a* such that end 66*a* is progressively engaged by angled portion 58*a*, thereby displacing actuating arm 66 in a direction axially toward, or inward, relative to body 62 and away from trigger pin 32 until arm 66 is in the fully seated position. The inward displacement of arm 58 compresses spring 64. Arm 58 is constructed of, for example, spring steel, such that it can deflect after actuating arm 66 is fully seated, thus allowing the axial location of actuator 62 to vary relative to RFF 40.

At approximately the maximum pivot of RFF body 12, i.e., when the corresponding valve is fully open, trigger pin 32 of locking pin assembly 20 is no longer engaged by actuating arm 66. Thus, actuating arm 66 no longer retains locking pin assembly 20 in the coupled mode. However, the load of the valve spring (not shown) of the corresponding valve on RFF body 12 via roller 26 prevents locking pin mechanism 20 from translating out of the coupled position. Thus, locking pin mechanism remains in the coupled position as the cam rotates from the high-lift position back toward base circle. As the cam rotates back toward base circle, arm 58, actuating arm 66, and RFF body 12 return to the position depicted in FIG. 4A.

The decoupled mode is selected by energizing actuating device 60 some time prior to a valve-opening event. Thus, actuating device 60 is energized some time prior to the situation when arm 58, actuating arm 66 and RFF body 12 are in the relative positions depicted in FIG. 4B. As the valve-opening event occurs, arm 58 pushes actuating arm 66 axially toward actuating device 60 and away from trigger pin 32. Energizing actuating device 60 simply maintains actuating arm 66 in the retracted position, i.e., translated away from RFF body 12 as shown in FIG. 4B, and resists or overcomes the force of spring 64, which tends to bias actuating arm 66 in a direction toward RFF body 12. Actuating device 60 is relatively low powered since retraction of actuating arm 66 to the fully seated position is accomplished by the force applied thereto by arm 58 of bracket 44, and extension is accomplished by the biasing force of spring 64 in the absence of a counteracting force applied by arm 58.

As best shown in FIG. 4C, energizing actuating device 60 maintains actuating arm 66 in the retracted position, i.e., retracted axially away from RFF body 12 and trigger pin 32 of locking pin assembly 20. With the cam in its base circle position, roller 26 and, thus, RFF 40 are not loaded by the valve spring of the valve associated with RFF 40. Thus, trigger pin 32 translates outward, i.e., in a direction toward actuating device 60. Locking pin assembly 20 is then biased into the decoupled position by the internal spring thereof, and RFF 40 is thereby placed into the decoupled mode of operation. Since roller 26 is decoupled from RFF body 12, the rotation of the cam is not transferred to pivotal motion of RFF body 12, and the corresponding valve is not actuated or is actuated according to the lift profile of low-lift cam lobes associated with RFF 40. Thus, the mechanism is self timed to allow the translation of locking pin assembly 20 to occur only at the beginning of the base circle phase of the cam profile.

RFF 40 remains in the decoupled mode of operation until actuating device 60 is de-energized. With actuating device 60 de-energized, spring 64 biases actuating arm 66 outward, i.e., in a direction toward RFF 40, and into engagement with trigger pin 32. When the cam returns to base circle, end 66*a* of actuating arm 66 engages and displaces trigger pin 32 in a direction away from actuating device 60, and thereby translates locking pin assembly 20 back into the coupled position.

While this invention has been described as having a preferred design, the present invention can be further modified within the spirit and scope of this disclosure. This application is therefore intended to cover any variations, uses, or adaptations of the present invention using the general principles disclosed herein. Further, this application is intended to cover such departures from the present disclosure as come within the known or customary practice in the art to which this invention pertains and which fall within the limits of the appended claims.

What is claimed:

1. A mechanical assist actuation bracket for a roller finger follower, said roller finger follower having a locking pin assembly, said locking pin assembly including a trigger pin, an actuating device disposed proximate said roller finger follower, said actuating device including an actuating arm configured for engaging said trigger pin, said mechanical assist actuation bracket comprising:

a face configured for being affixed to the roller finger follower; and an arm extending from said face, said arm configured for translating the actuating arm in a direction toward and away from said trigger pin during pivotal movement of the roller finger follower.

2. The mechanical assist actuation bracket of claim 1, wherein said arm extends from said face at an angle relative thereto.

3. The mechanical assist actuation bracket of claim 2, wherein said angle is from approximately twenty degrees to approximately seventy-five degrees relative to a plane of said face.

4. The mechanical assist actuation bracket of claim 1, further comprising an orifice defined by said face, said orifice dimensioned for receiving the trigger pin to thereby enable the trigger pin to extend through said orifice in a direction away from the roller finger follower.

5. The mechanical assist actuation bracket of claim 1, wherein said arm includes a first portion and a second portion, said first portion extending from said face at an angle of from approximately twenty degrees to approximately seventy-five degrees relative to a plane of said face, said second portion extending from said first portion and being substantially parallel with the plane of said face.

6. A mechanical assist actuation roller finger follower, comprising:

a body including a first side and a second side, said first side defining a bore therethrough;

a hollow shaft having a central axis, said shaft including a first end disposed adjacent said first side and a second end disposed adjacent said second side;

a roller carried by said shaft;

a locking pin assembly disposed at least partially within said shaft and being substantially concentric therewith, said locking pin assembly including a trigger pin extending in an axial direction from said bore in said first side in a direction away from said body; and a mechanical assist actuation bracket affixed to said first side.

7. The mechanical assist actuation roller finger follower of claim 6, wherein said mechanical assist actuation bracket further comprises:

a face, said face being generally parallel relative to said first side; and an arm extending from said face, said arm configured for translating an actuating arm of a actuating device associated with said mechanical assist actuation roller finger follower in a direction toward and away from said trigger pin during pivotal movement of said roller finger follower.

8. The mechanical assist actuation roller finger follower of claim 7, wherein said arm extends from said face at an angle relative thereto.

9. The mechanical assist actuation roller finger follower of claim 8, wherein said angle is from approximately twenty degrees to approximately seventy-five degrees relative to a plane of said face.

10. The mechanical assist actuation roller finger follower of claim 6, further comprising an orifice defined by said face, said trigger pin extending through said orifice in a direction away from said first and second sides.

11. The mechanical assist actuation roller finger follower of claim 6, wherein said arm includes a first portion and a second portion, said first portion extending from said face at an angle of from approximately twenty degrees to approximately seventy-five degrees relative to a plane of said face, said second portion extending from said first portion and being substantially parallel with the plane of said face.

12. The mechanical assist actuation roller finger follower of claim 6, wherein said bracket is attached to said roller finger follower by one of a snap fit and a crimp fit.

13. A mechanical assist actuation roller finger follower system, comprising:

one of a deactivation and a two-step roller finger follower, said roller finger follower including:

a body having a first side and a second side, said first side defining a bore therethrough;

a hollow shaft having a central axis, said shaft including a first end disposed adjacent said first side and a second end disposed adjacent said second side;

a roller carried by said shaft; and a locking pin assembly disposed at least partially within said shaft and being substantially concentric therewith, said locking pin assembly including a trigger pin extending in an axial direction from said bore in said first side in a direction away from said body, said trigger pin being translatable to thereby place said locking pin assembly into one of a coupled and a decoupled position;

a mechanical assist actuation bracket affixed to said first side of said roller finger follower; and a actuating device, including:

a body;

an actuating arm extending from said body, said actuating arm being translated into and out of engagement with said trigger pin by said mechanical assist actuation bracket during pivotal movement of said roller finger follower; and a spring biasing said actuating arm in the direction of said trigger pin.

14. The mechanical assist actuation roller finger follower system of claim 13, said mechanical assist actuation bracket further comprising:

a face, said face being generally parallel relative to said first side of said roller finger follower; and an arm extending from said face, said arm translating said actuating arm of said actuating device into and out of engagement with said trigger pin during pivotal motion of said roller finger follower.

15. The mechanical assist actuation roller finger follower system of claim 14, wherein said arm extends from said face at an angle relative thereto.

16. The mechanical assist actuation roller finger follower system of claim 15, wherein said angle is from approximately twenty degrees to approximately seventy-five degrees relative to a plane of said face.

17. The mechanical assist actuation roller finger follower system of claim 13, further comprising an orifice defined by said face, said trigger pin extending through said orifice in a direction away from said first and second sides.

18. The mechanical assist actuation roller finger follower system of claim 13, wherein said arm includes a first portion and a second portion, said first portion extending from said face at an angle of from approximately twenty degrees to approximately seventy-five degrees relative to a plane of said face, said second portion extending from said first portion and being substantially parallel with the plane of said face.

19. The mechanical assist actuation roller finger follower system of claim 13, wherein said bracket is attached to said roller finger follower by one of a snap fit and a crimp fit.

20. The mechanical assist actuation roller finger follower system of claim 13, wherein said actuating device is energized to hold said actuating arm out of engagement with said trigger pin to thereby switch said locking pin assembly into one of said decoupled mode and said coupled mode.

* * * * *